United States Patent [19]

Bakker

[11] 4,137,184

[45] Jan. 30, 1979

[54] OVERBASED SULFONATES

[75] Inventor: Nicolaas Bakker, Pinole, Calif.

[73] Assignee: Chevron Research Company, San Francisco, Calif.

[21] Appl. No.: 751,422

[22] Filed: Dec. 16, 1976

[51] Int. Cl.[2] ..... C10M 1/40; C10M 3/34; C10M 5/22; C10M 7/38

[52] U.S. Cl. ..... 252/33; 252/389 R

[58] Field of Search ..... 252/33, 389 R

[56] References Cited

U.S. PATENT DOCUMENTS

| | | | |
|---|---|---|---|
| 2,865,957 | 12/1958 | Logan | 252/33 |
| 2,883,340 | 4/1959 | Wasley et al. | 252/33 |
| 3,422,013 | 1/1969 | Scher | 252/33 |
| 3,489,682 | 1/1970 | Le Suer | 252/33 |
| 3,496,105 | 2/1970 | Le Suer | 252/18 |
| 3,704,105 | 11/1972 | Perilstein | 252/33 |
| 3,959,164 | 5/1976 | Sabol | 252/33 |

FOREIGN PATENT DOCUMENTS

| | | | |
|---|---|---|---|
| 1225039 | 3/1971 | United Kingdom | 252/33 |

*Primary Examiner*—Delbert E. Gantz
*Assistant Examiner*—Irving Vaughn
*Attorney, Agent, or Firm*—C. J. Tonkin; L. L. Vaughan; C. J. Tonkin

[57] ABSTRACT

Metal sulfonates of the formula R—$SO_3M$ wherein R is hydrocarbyl and M is a Group I or Group II metal or lead are overbased with Group II metal carbonate, bicarbonate, oxide or hydroxide. Also provided are lubricating oil compositions or concentrates containing these overbased sulfonates.

9 Claims, No Drawings

OVERBASED SULFONATES

BACKGROUND OF THE INVENTION

1. Field of the Invention

This invention relates to Group II metal carbonate overbased metal sulfonates and to lubricating oil additive concentrates and lubricating oil compositions containing them.

Lubricating oil compositions, particularly for use in internal combustion engines, have long performed many functions besides simply lubricating relatively moving parts. Modern-day, highly compounded lubricating oil compositions provide antiwear, antioxidant, extreme-pressure and antirust protection in addition to maintaining the cleanliness of the engine by detergency and dispersancy. Many lubricating oil additives are well known for accomplishing these functions.

2. Description of the Prior Art

Mixon et al, U.S. Pat. No. 2,367,468, teach the use in a lubricating oil of a composition prepared by reacting a hydrocarbon with chlorosulfonic acid and a sulfurizing agent followed by treatment with a neutralizing agent including the oxides, hydroxides, carbonates and bicarbonates of Group II metal salts. The treatment of isobutylene polymer with chlorosulfonic acid followed by treatment with alcoholic potassium hydroxide is specifically disclosed.

Wasley et al, U.S. Pat. No. 2,883,340, teach overbased polyolefin sulfonates for use as detergents in lubricating oil compositions. The polyolefin has a molecular weight from 10,000 to 50,000, and polyisobutylene or copolymers thereof are preferred.

British Pat. No. 1,246,545 discloses the use in a lubricating oil of a sulfonate prepared by reacting polyisobutylene with chlorosulfonic acid followed by treatment with lime to prepare the corresponding calcium polyisobutenyl sulfonate.

Methods for overbasing Group II metal petroleum sulfonates are taught in, for example, U.S. Pats. No. 3,027,325, 3,312,618, 3,422,013, 3,488,284, 3,492,231, 3,523,896 and 3,537,996.

SUMMARY OF THE INVENTION

The Group II metal carbonate overbased metal sulfonates of the formula R—$SO_3M$ of this invention are useful as lubricating oil additives. They may be stored as lubricating oil additive concentrates comprising 90 to 10% by weight of a lubricating oil and 10 to 90% by weight of the Group II metal carbonate overbased metal sulfonate.

The lubricating oil compositions containing the novel sulfonates of this invention have excellent detergent and dispersant properties and rust and hydrolytic stability properties, and are also excellent at preventing varnish formation in internal combustion engines.

DETAILED DESCRIPTION OF THE INVENTION

The novel sulfonates of this invention are Group II metal carbonate overbased metal sulfonates of the formula R—$SO_3M$ where R is a substantially saturated aliphatic hydrocarbyl substituent containing from about 50 to 300 and preferably from about 50 to 250 carbon atoms. "Substantially saturated" means that at least about 95% of the carbon-to-carbon covalent linkages are saturated. Too many sites of unsaturation make the molecule more easily oxidized, degraded and polymerized. This makes the products unsuitable for many uses in hydrocarbon oils.

The substantially saturated hydrocarbyl substituent may contain polar substituents. However, there should not be enough substituents to change the hydrocarbon character of the radical. Such polar substituents are exemplified by chloro, keto, alkoxy, etc. The presence of such polar groups is not preferred. The polar substituents on the radical should not be more than approximately 10% based on the weight of the hydrocarbon portion of the radical.

The sources of the substantially saturated hydrocarbyl substituent include principally substantially saturated olefin polymers, particularly polymers of monoolefins having from about 2 to about 30 carbon atoms. The especially useful polymers are the polymers of 1-monoolefins such as ethylene, propene, 1-butene, isobutene, 1-hexene, 1-octene, 2-methyl-1-heptene, 3-cyclohexyl-1-butene and 2-methyl-5-propyl-1-hexene. Polymers of olefins in which the olefinic linkage is not at the terminal position, such as 2-butene, 3-pentene and 4-octene, are also useful.

Interpolymers of olefins, such as those illustrated above, with other interpolymerizable olefinic substances such as 1-olefins, aromatic olefins, cyclic olefins and polyolefins, can also be used. These include those prepared by polymerizing isobutene with styrene, isobutene with butadiene, propene with isoprene, ethylene with piperylene, isobutene with chloroprene, isobutene with alpha-methylstyrene, 1-hexene with 1,3-hexadiene, 1-octene with 1-hexene, 1-heptene with 1-pentene, 3-methyl-1-butene with 1-octene, 3,3-dimethyl-1-pentene with 1-hexene, isobutene with styrene and piperylene, etc.

The relative proportions of the monoolefins to the other monomers in the interpolymers influence the stability and oil solubility of the final compositions. To have oil solubility and stability, the interpolymers should be substantially aliphatic and substantially saturated, i.e., they should contain at least about 80%, and preferably at least about 95%, on a weight basis, of units derived from the aliphatic monoolefins and no more than about 5% of the olefinic linkages, based on the total number of carbon-to-carbon covalent bonds. Usually, each molecule would have about one olefinic linkage. The percentage of olefinic linkages should be less than about 2% of the total number of carbon-to-carbon covalent linkages.

Specific examples of such interpolyers include copolymers of 95% by weight of isobutene with 5% styrene, terpolymer of 98% isobutene and 1% piperylene and 1% chloroprene, terpolymer of 95% isobutene with 2% 1-butene and 3% 1-hexene, terpolymer of 60% isobutene with 20% 1-pentene and 20% 1-octene, copolymer of 80% 1-hexene and 20% 1-heptene, terpolymer of 90% isobutene with 2% cyclohexene and 8% propene, and copolymer of 80% ethylene and 20% propene.

The metal component M of the metal sulfonate can be any of the Group I or Group II metals or lead which forms a salt with the sulfonic acid moiety and which yields a salt which when overbased can function as a detergent in lubricating oil compositions. Preferably the Group I metals include lithium, sodium and potassium, and the Group II metals include magnesium, calcium, strontium, barium and zinc. The lead must be in the +2 valence state, i.e., $Pb^{++}$. More preferably the metal M is calcium, magnesium or barium.

The hydrocarbon from the sources mentioned above can be converted into the corresponding sulfonic acid or salt thereof by two distinct procedures. In one procedure, the hydrocarbon is reacted with a conventional sulfonating agent such as sulfur trioxide, chlorosulfonic acid, etc. Chlorosulfonic acid is preferred. These methods are well known in the art.

In an alternative preparation of the hydrocarbylsulfonic acid, the hydrocarbon is first reacted with an alkyl bromo or chlorosulfonate, optionally in the presence of a solvent such as 1,2-dichloroethane, ether, and the like. The reaction proceeds satisfactorily at temperatures from 20°-120° C, preferably from 70°-90° C, but below the decomposition point of the reactants and products. The reaction may be carried out at subatmospheric, atmospheric or superatmospheric pressures; however, for the sake of convenience, the reaction is ordinarily conducted at atmospheric pressure.

The hydrocarbon and alkyl chlorosulfonate are ordinarily reacted using a slight molar excess of the sulfonate, based on the hydrocarbon. Preferably from 1.1 to 2 mols of alkyl chlorosulfonate per mol of hydrocarbon is employed.

The alkyl portion of the alkyl chlorosulfonate contains from 1 to 4 carbon atoms. Ethyl chlorosulfonate is preferred because it is easily prepared and reacts readily with olefinic hydrocarbon.

The Group I and Group II metals can be introduced into the sulfonate molecules by any suitable means. One successful method comprises combining a basically reacting compound of the metal, such as the hydroxide, with the acid or alkyl ester of the hydrocarbyl sulfonic acid prepared as described above. This is generally carried out in the presence of a hydroxylic promoter such as water, methanol or ethylene glycol, and an inert solvent for the sulfonate, typically with heating. Under these conditions, the basically reacting compound will yield the metal sulfonate. The hydroxylic promoter and solvent can then be removed to yield the metal sulfonate.

Under certain circumstances, it may be more convenient to prepare Group I metal salts of the sulfonate and convert this material by metathesis into the Group II metal or lead sulfonate. Using this method the sulfonic acid or sulfonate prepared above is combined with a basic Group I metal compound such as sodium or potassium hydroxide. The sodium or potassium sulfonate obtained can be purified by aqueous extraction. Then, the Group I metal sulfonate is combined with the Group II metal salt or lead salt to form the Group II metal or lead sulfonate. The most commonly used Group II metal compound is a halide, particularly a chloride. A suitable lead compound is lead nitrate or lead acetate. Typically the sodium or potassium sulfonate is combined with an aqueous chloride solution of the Group II metal or lead salt and stirred for a sufficient time to allow metathesis to occur. Thereafter the water phase is removed and the solvent may be evaporated, if desired.

If a sulfonate having a completely saturated hydrocarbyl group is desired, it must be hydrogenated using hydrogen, and a conventional noble metal or noble metal oxide hydrogenation catalyst, such as platinum or platinum oxide.

The preferred sulfonates are Group II sulfonates, especially calcium, barium and magnesium, and most preferred are the calcium and magnesium sulfonates.

The sulfonates of this invention are overbased sulfonates. Overbased materials are characterized by a metal content in excess of that which would be present according to the stoichiometry of the metal cation in the particular organic compound said to be overbased. Thus, an oil-soluble monosulfonic acid when neutralized with a Group II basic metal compound, such as a calcium compound, will produce a normal sulfonate containing one equivalent of calcium for each equivalent of acid. In other words, the normal metal sulfonate will contain one mol of calcium for each two mols of the monosulfonic acid.

By applying well-known procedures, overbased or basic complexes of the sulfonic acid can be obtained. These overbased materials contain amounts of metal many times in excess of that required to neutralize the acid. These stoichiometric excesses can vary considerably, e.g., from about 0.1 to about 30 or more equivalents, depending upon the reactants, process conditions, etc.

The degree of overbasing can be expressed in several ways. One way is to describe the metal ratio. This method describes the ratio of the total chemical equivalents of metal in the product to the chemical equivalents in the compound said to be overbased, based on the known chemical reactivity and stoichiometry of the two reactants. Thus, in a normal, neutral calcium sulfonate the metal ratio is 1, and in overbased sulfonate the metal ratio can range from about 1.1 to 30 or more, generally from about 5 to 20.

Another method of expressing the degree of overbasing is to describe the base ratio. This method describes the ratio of chemical equivalents of basic metal to the chemical equivalents of neutral metal. The neutral metal is the metal which would be expected to react with the compound to be overbased, i.e., the metal required to neutralize the sulfonic acid. The basic metal is the metal in excess of the neutral metal, i.e., it is the metal available to neutralize the acidic combustion products. Thus, a normal, neutral metal sulfonate has a base ratio of zero, and an overbased sulfonate can have a base ratio ranging from about 0.1 to about 30 or more, generally from about 4 to about 19.

Another method of specifying the degree of overbasing of sulfonates is by stating the alkalinity value (AV) of the composition. The method for determining the alkalinity value of an overbased composition is set forth in ASTM method D-2896. Briefly, the alkalinity value is stated as the number of milligrams of potassium hydroxide per gram of composition to which the overbasing is equal. For example, if the composition is overbased to the extent that it has the same acid-neutralizing capacity per gram to 10 milligrams of potassium hydroxide, the composition is given an alkalinity value of 10. The lower limit of alkalinity value is zero for a neutral sulfonate with values of 10 to 50 being common for slightly overbased sulfonates. Highly overbased sulfonates have values ranging from about 200 to about 450.

Preferably the sulfonates of this invention are overbased with calcium, barium or magnesium carbonate, more preferably calcium or magnesium carbonate.

Lubricating oil compositions of this invention contain an amount of the novel overbased sulfonates of this invention sufficient to provide a dispersant properties, typically from 0.1 to 10% wt., preferably from 0.5 to 7% wt.

A discussion of the general methods for preparing overbased sulfonates and other overbased products is disclosed in LeSuer, U.S. Pat. No. 3,496,105, issued Feb. 17, 1970, particularly at Cols. 3 and 4.

Additive concentrates are also included within the scope of this invention. They include from about 90to 10 weight percent of an oil of lubricating viscosity and from about 10 to 90 weight percent of the Group II metal carbonate overbased metal hydrocarbyl sulfonate of this invention. The concentrate should contain as such of the overbased sulfonate as is possible, since the concentrates are prepared to reduce shipping costs, storage requirements, etc. Typically, the concentrates contain only sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions. suitable lubricating oils which can be used as diluents typically have viscosities in the range from about 35 to about 500 Saybolt Universal Seconds (SUS) at 100° F, although any oil of lubricating viscosity can be used.

Suitable lubricating oil switch can be used to prepare a lubricating oil composition or concentrate are oils of lubricating viscosity derived from petroleum or synthetic sources. The oils can be paraffinic, naphthenic, halosubstituted hydrocarbons, synthetic esters, or combinations thereof. Oils of lubricating viscosity have viscosities in the range from 35 to 50,000 SUS at 100° F, and more usually from about 50 to 10,000 SUS at 100° F.

Other conventional additives which can be used in combinations with the overbased sulfonate of this invention include oxidation inhibitors, antifoam agents, viscosity index improvers, pour point depressants, dispersants and the like. These include such compositions as chlorinated wax, benzyl disulfide, sulfurized sperm oils, sulfurized terpene, phosphorus esters such as trihydrocarbon phosphites, metal thiocarbamates such as zinc dioctyldithiocarbamate, metal phosphorus dithioates such as znc dioctylphosphorodithioate, polyisobutylene having an average molecular weight of 100,000, succinimides etc.

The lubricating oil compositions of the invention are useful for lubricating internal combustion engines, automatic transmissions and as industrial oils such as hydraulic oils, heat transfer oils, torque fluids, etc. The lubricating oils can not only lubricate the engines but, because of their dispersancy properties, help maintain a high degree of cleanliness of the lubricated parts.

EXAMPLES

The following is an illustrative preparation of a composition falling outside the scope of this invention. Testing of this composition is shown in Table II.

Example A

Preparation of Calcium Polyisobutenyl Sulfonate

To a 10-gallon glass-lined reactor are added 14,430 g of polyisobutylene having a number average molecular weight of 330 and an approximate average carbon number of 24, and 20,600 g of 1,2-dichloroethane. To this mixture is slowly added over a period of 1¼ hour 7650 g chlorosulfonic acid. The reaction mixture is cooled continuously during the chlorosulfonic acid addition to maintain the temperature at 60° F. after the addition is completed, the reaction mixture is heated to 140° F. After maintaining the temperature of the reaction mixture at 140° F for 5½ hours, there is added slowly over a period of one hour a solution of 3200 g NaOH in 6400 ml methaol. The reaction mixture is then stripped to 196° F at atmospheric pressure, and one gallon of hydrocarbon thinner and 130 g NaOH in 260 ml methanol are added and the stripping operation continued to 248° F at atmosheric pressure. The contents of the reactor are cooled and transferred to a large reactor and sec.butyl alchol and a solution of 6300 g $CaCl_2$ in 32 liters of water is then added. This mixture is stirred at 100°–120° F for 45 minutes. After settling, the water layer is drained off and the metathesis repeated twice with 3900g $CaCl_2$in 18 liters of water. The reaction mixture is then washed 3 times with approximately 4 gallons of water. 1 kg $Ca(OH)_2$ is added after the first water wash. After the water from the last wash is drained off, the supernatant product solution is filtered through diatomaceous earth. 3000 g of diluent oil is added to the filtrate and the mixture stripped to 280° F and 60 mm Hg pressure to yield 17,070 g of calcium sulfonate concentrate containing 1.85% Ca, 4.57% S and 0.30% Cl. Neutral calcium as sulfonate, determined by Hyamine titration, a procedure published in Analytic Chemistry, Vol. 26, September 1954, pp. 1492–1497, authors Ralph House and J. L. Darragh, is 1.81%.

Calcium Carbonate Overbased Calcium Sulfonate

To a 5-liter, 3-neck flask are added 460 g conc. of a calcium sulfonate of polyisobutylene prepared above, 80 g of diluent oil, 2000 ml xylene, 280 ml 2-ethyl-1-hexanol, 200 ml methanol and 178 g of calcium hydroxide. The reaction mixture is carbonated at ambient temperature for 82 minutes at such a rate that all the carbon dioxide is taken up without off-gas. The total amount of carbon dioxide bubbled into the reaction mixture is 92 g. The temperature of the reaction mixture is then raised to 141° C as quickly as possible, with nitrogen bleed and a slight vacuum being applied while taking off solvent overhead. The mixture is then cooled and filtered through diatomaceous earth. The filtrate is stripped to 175° C bottoms at 5 mm Hg for ¼ hour to yield 714 g of calcium carbonate overbased calcium sulfonate in oil having an alkalinity value of 299 (10.68% basic calcium).

The product contains 12.0% calcium, 3.00% sulfur and 0.17% chlorine by x-ray fluorescence analysis. Duplicate Hyamine titrations of this product indicated 1.38, 1.40% neutral calcium as sulfonate in the product.

The following examples are included to further illustrate the invention.

Example 1

Preparation of Sodium Polyisobutenyl Sulfonate

To a 10-gallon glass-lined reactor are added 12,000 g of polyisobutylene having a number average molecular weight of 950 and an approximate average carbon number of 68, and 6000 g of 1,2-dichloroethane. To this mixture is slowly added over a period of 1½ hours a solution of 2100 g chorosulfonic acid in 6000 g butyl ether. The reaction mixture is cooled continuously to maintain the temperature at 40° F. After the addition is completed, the reaction mixture is warmed to 104° F. After maintaining the temperature of the reaction mixture at about 100° F for about 5 hours, there is added slowly over a period of 2 hours 3810 ml of a 25% aqueous sodium hydroxide solution (approximately 1150 g NaOH). 1000 ml of hydrocarbon thinner is added and the reaction mixture is stripped to 195° F at atmospheric pressure. An additional 10,000 ml of hydrocarbon thinner is then added to yield 32,090 g of product.

Example 2

Preparation of Sodium Polyisobutenyl Sulfonate

The procedure of Example 1 is repeated with the exception that the reaction mixture is neutralized with a methanolic solution of sodium hydroxide prepared from 1020 g NaOH and 4300 ml of methanol. The product is 26,780 g of sodium polyisobutenyl sulfonate solution.

Example 3

Preparation of Calcium Polyisobutenyl Sulfonate

To the product solutions of Examples 1 and 2 are added half a volume of hydrocarbon thinner and half a volume of isobutyl alcohol and mixed thoroughly. This is the feed used in the continuous metathesis process.

The apparatus consists of a metathesis column 100 × 5 cm and a water-wash column 100 ×11.5 cm, both packed with ¼inch Penn State packing and maintained at 40° C with heating tape.

The metathesis column is filled with 20% aqueous $CaCl_2$solution. $CaCl_2$ solution and water are fed into the columns 20 cm from the top at 40 and 80 ml/min, respectively. The outlets are at the very bottom of the columns. The height of the $CaCl_2$ solution and the water level in the columns is controlled by raising or lowering the outlet of 5/16 inch tubing connected to the bottom outlet of the columns and usually maintained 15 cm from the top.

The product feed solution is pumped into the metathesis column 20 cm from the bottom at 20 ml/min. and taken off 2 cm from the top. Residence time of the product in the metathesis column is 20 minutes. The metathesized product is then pumped into the water-wash column 20 cm from the bottom at 20 ml/min. and taken off 2 cm from the top.

To the water-washed product is then added enough $Ca(OH)_2$ to neutralize any acid product that may have formed and enough diluent oil to give a 70% concentrate after stripping off of the solvent. The stripped and filtered product contains by x-ray fluorescence analysis 1.31% calcium, 1.97% sulfur, 0.07% chlorine and 1.10% neutral calcium is sulfonate by Hyamine titration.

EXAMPLE 4

Calcium Carbonate Overbased Calcium Polyisobutenyl Sulfonate

To a 1-liter, 3-neck flask with nitrogen sparge are added 410 g of calcium polyisobutenyl sulfonate solution containing 147 g calcium sulfonate wherein the polyisobutylene has a number average molecular weight of 950, and 100 g diluent oil. The mixture is stripped to 160° C bottoms under vacuum. To this mixture is added 500 ml of hydrocarbon thinner. The solution is transferred to a 2-liter, baffled, 3-neck flask and 50 ml methanol, 70 ml 2-ethyl-1-hexanol and 100 g calcium hydroxide are added. The mixture is carbonated for 3 hours at 34°–40° C with 60 g of $CO_2$. The solution is then heated to 160° C at atmospheric pressure while solvent is removed overhead. After cooling, the mixture is filtered through diatomaceous earth. The filtrate is stripped to 170° C bottoms at 6 mm Hg to yield 337 g of calcium carbonate-overbased calcium polyisobutenyl sulfonate concentrate. The alkalinity value of this overbased sulfonate is 363, with 12.96% basic calcium. Hyamine titration indicated 0.68% neutral calcium as sulfonate. The base ratio for the product is 19:1.

EXAMPLE 5

Calcium Carbonate Overbased Calcium Polyisobutenyl Sulfonate

To a 2-liter, baffled, 3-necked flask is added 799 g of calcium polyisobutenyl sulfonate solution straight from the water wash column (see Example 3) containing 288 g calcium sulfonate wherein the polyisobutenyl group has a number average molecular weight of 950; 50 ml methanol, and 200 g calcium hydroxide. The reaction mixture is carbonated at ambient temperature for 160 minutes with 110 g of $CO_2$. During the carbonation the temperature increases to a maximum of 54° C. To the reaction mixture is added 500 ml of hydrocarbon thinner. Solvent is then distilled off to 150° C bottoms at atmospheric pressure. The solution is cooled and filtered through diatomaceous earth and the filtrate is stripped to 170° C bottoms at 6 mm Hg. Shortly before all of the solvent has been removed, 160 g of diluent oil is added to yield 543 g of calcium carbonate overbased calcium polyisobutenyl sulfonate having an alkalinity value of 253 (9.04% basic calcium). The product contains 0.75% neutral calcium as sulfonate and has 9.26% calcium, 1.29% sulfur and 0.07% chlorine content as determined by x-ray fluorescence analysis. The base ratio is 12.0:1.

EXAMPLE 6

Calcium Carbonate Overbased Calcium Polyisobutenyl Sulfonate

To a 1-liter, 3-neck flask is added 400 g of calcium polyisobutenyl sulfonate solution containing 144 g calcium sulfonate wherein the polyisobutylene has a number average molecular weight of 950, and 80 g of diluent oil. The mixture is stripped to 160° C bottoms under vacuum, yielding 249 g overhead. To the product in the flask are added 500 ml of hydrocarbon thinner, 50 ml methanol, 70 ml 2-ethyl-1-hexanol and 74 g of calcium hydroxide. This mixture is carbonated at ambient temperature with 41 g $CO_2$. The temperature increases to 39° C over a period of 130 minutes. The mixture is heated to 155° C bottoms at atmospheric pressure while taking off solvent overhead, and then is heated to 130° C under vacuum. The mixture is cooled, filtered through diatomaceous earth and the filtrate is stripped to 170° C at 6 mm Hg to yield 310 g of product in lubricating oil having an alkalinity value of 315 (11.26% basic calcium), a base ratio of 16.3:1 and a Hyamine titration value of 0.69% neutral calcium as sulfonate.

EXAMPLE 7

Preparation of Magnesium Polyisobutenyl Sulfonate

To a 500-ml, 3-neck flask containing 100 ml dibutyl ether is added slowly from a dropping funnel 57 g of chlorosulfonic acid over a period of 5 minutes with ice-water cooling to maintain the temperature below 20° C. A 2-liter, 4-necked flask with nitrogen sparge is charged with 300 g of polyisobutylene having a number average molecular weight of 950 and 150 ml of 1,2-dichloroethane. To this mixture is added from a dropping funnel the chlorosulfonic acid solution over a period of 10 minutes while the temperature increases from 22° to 28° C. The reaction mixture is maintained at 40°

C for 5 hours. Then a solution of 58 g 98% sodium hydroxide pellets in 150 ml water is added dropwise over a period of 10 minutes. During the course of the addition, the temperature is maintained below 25° C by cooling. To this solution are added 600 ml of hydrocarbon thinner and 50 ml 2-ethyl-1-hexanol. The temperature is increased to 165° C and maintained for 1 hour. 660 ml of solution is distilled overhead. To the remaining reaction mixture is added, after cooling, 200 ml hydrocarbon thinner, 300 ml 2-butanol and 400 ml water. The mixture is stirred at 80°-85° C for ½ hour, transferred to a 4-liter separatory funnel, and the water layer is removed. The supernatant liquid is added to to a 2-liter, 4-necked flask and 130 g of magnesium chloride hexahydrate in 400 ml water is added. The mixture is stirred at 80°-85° C for 1 hour and then transferred while still hot to a 4-liter separatory funnel. After standing, the aqueous layer is removed and the supernatant liquid is transferred to a 2-liter, 4-necked flask. This procedure is repeated 2 times and then the remaining solution is washed 3 times with 400 ml water. The supernatant liquid is heated to 145° C bottoms at atmospheric pressure. 375 ml liquid is distilled overhead. The remaining material is cooled and filtered through diatomaceous earth. This filtrate is stripped to 170° C bottoms at 6 mm Hg. Shortly before the stripping is completed, 130 g diluent oil is added to yield 450 g of magnesium polyisobutenyl sulfonate in oil. The product contains 0.57% neutral magnesium as sulfonate by a Hyamine titration; Mg=0.62% by emission spectroscopy; S=1.88% and Cl=≦0.01%, each by x-ray fluorescence analysis.

EXAMPLE 8

Magnesium Carbonate Overbased Magnesium Polyisobutenyl Sulfonate

To a 5-liter, 4-neck flask with nitrogen sparge is added 434 g of the magnesium polyisobutenyl sulfonate prepared in Example 7 and 2000 ml hydrocarbon thinner. The solution is heated to 80° C and to it is added slowly over a period of 35 minutes 434 g of methyl magnesium carbonate solution containing 5.9 weight percent of Mg. The temperature of addition is 80° to 90° C. After this addition is complete, the temperature is raised to 105° C and then cooled to 60° C. 69 ml water is added. The mixture is stirred for 20 minutes and then heated to 137° C in 75 minutes. The mixture is cooled and filtered through diatomaceous earth and then stripped to 165° C bottoms at 6 mm Hg to yield 501 g of magnesium carbonate overbased magnesium polyisobutenyl sulfonate having an alkalinity value of 224 (4.80% basic magnesium) and 0.52% neutral magnesium by Hyamine titration. The base ratio of the product is 9.2.

EXAMPLE 9

Calcium carbonate Overbased Magnesium Polyisobutenyl Sulfonate

To 138 g of magnesium polyisobutenyl sulfonate, wherein the polyisobutenyl group has a number average molecular weight of 950 (prepared according to the procedure of Example 7) and containing 0.58% magnesium, are added 38 g diluent oil, 910 ml hydrocarbon thinner, 52 ml 2-ethyl-1-hexanol, 38 ml methanol and 60 g calcium hydroxide. The mixture is carbonated with $CO_2$ gas at from 23°-39° C for 2¼ hours. The temperature of the mixture is then raised to 135° C bottoms at atmospheric pressure under nitrogen sparge. The mixture is then cooled and filtered through diatomaceous earth, followed by stripping to 165° C bottoms at 8 mm Hg, to yield 248 g of product having an alkalinity value of 317, equal to 11.31% basic calcium.

EXAMPLE 10

Calcium Carbonate Overbased Calcium Polyisobutenyl Sulfonate

To a 500-ml flask are added 169 ml dibutyl ether and 87 g chlorosulfonic acid. The addition of the chlorosulfonic acid is carried out dropwise with cooling to maintain the temperature between 3°-17° C.

To a 2-liter flask under nitrogen are added 320 g (0.5 mol) of polyisobutylene containing an average of 46 carbon atoms and having a number average molecular weight of 640 and 150 ml of 1,2-dichloroethane. From a dropping funnel is added slowly over a period of 21 minutes the chlorosulfonic acid solution prepared above at a temperature from 17°-28° C. The reaction mixture is maintained at 40° C for 5 hours. It is then cooled to 25°-15° C and a solution of 90 g NaOH pellets (98%) in 200 ml of water is added over a period of 23 minutes. To the mixture are then added 660 ml of hydrocarbon thinner and 55 ml of 2-ethyl-1-hexanol. The temperature is raised to 165° C bottoms at atmospheric pressure with nitrogen sparge and maintained for 1 hour. The mixture is then cooled and 220 ml of hydrocarbon thinner, 330 ml 2-butanol and 440 ml water are added. The mixture is stirred at 80°-85° C for ½ hour, allowed to settle and the water layer removed.

To a 2-liter flask is added the supernatant mixture from above and a solution of 111 g calcium chloride in 400 ml water. The mixture is stirred at 80°-85° C for 1 hour, allowed to settle and the water layer removed. This procedure is repeated twice and then the mixture is washed 3 times with a solution of 500 ml water and 0.4 g calcium hydroxide. The supernatant product is then added to a 2-liter flask with 100 g diluent oil and 1 g calcium hydroxide. The mixture is heated to 160° C bottoms at atmospheric pressure and then stripped at 165° C at 5 mm Hg to yield 458 g of calcium polyisobutenyl sulfonate.

To this sulfonate solution in oil are added 2000 ml hydrocarbon thinner, 150 ml 2-ethyl-1-hexanol, 110 ml methanol and 185 g calcium hydroxide. This mixture is carbonated with $CO_2$ for 2 hours 55 minutes at a temperature of 22°-42° C until $CO_2$ appears as an off-gas. The temperature is then raised to 132° C bottoms at atmospheric pressure. The mixture is cooled and filtered through diatomaceous earth and then 56 g diluent oil is added. The product is stripped to 175° C bottoms at 7 mm Hg to yield 707 g of calcium carbonate overbased calcium polyisobutenyl sulfonate containing 12.1% calcium, 1.97% sulfur and less than 0.03% chlorine. The product has an alkalinity value of 328 (11.73% basic calcium), a base ratio of 11.4:1 and a Hyamine titration value of 1.03% neutral calcium as sulfonate.

EXAMPLE 11

Calcium Carbonate Overbased Calcium Polyisobutenyl Sulfonate

To a 1-liter flask under nitrogen are added 300 g of polyisobutene having a number average molecular weight of 950, 60 ml of 1,2-dichloroethane and 67 g ethyl chlorosulfonate. The mixture is heated at 80° C for 6 hours. To the reaction mixture is added after cooling 53 g of 85% KOH pellets dissolved in 120 ml methanol. 240 ml hydrocarbon thinner is added, and the temperature is then raised to 150° C bottoms at atmospheric pressure. After standing overnight, a solution of 16 g of 85% KOH pellets in 50 ml methanol is added along with 25 ml 2-ethyl-1-hexanol. The temperature of the reaction mixture is raised to 160° C bottoms at atmospheric pressure and maintained at 160°-170° C for 1½ hours. The mixture is cooled and then 200 ml hydrocarbon thinner, 200 ml 2-butanol and 300 ml water are added. The mixture is stirred at 80° C for 1½ hours and then transferred to a separatory funnel, where the water layer is removed and the supernatant layer is transferred to a 2-liter flask. The mixture in the flask is washed 3 times for 1 hour at 80°-85° C with, respectively 60, 40 and 20 g anhydrous calcium chloride in 300 ml water; then 80 ml 2-butanol is added and the mixture is washed 3 times with 300 ml water while stirring for 1 hour at 80°-85° C. In the second and third water washes is also added 0.5 g calcium hydroxide. The supernatant solution is put in a 2-liter flask and 1 g calcium hydroxide, 25 ml water and 130 g diluent oil are added. The temperature of the mixture is raised to 160° C bottoms at atmospheric pressure and then stripped to 160° C bottoms at 30 mm Hg. The mixture is cooled and 600 ml hydrocarbon thinner is added. The mixture is filtered through diatomaceous earth and stripped to 170° C bottoms at 8 mm Hg to yield 448 g of calcium polyisobutenyl sulfonate having an alkalinity value of 2.8 and containing 0.78% neutral calcium by Hyamine titration. The product contains 0.84% calcium, 1.32% sulfur, and less than 0.01% chlorine by x-ray fluorescence analysis.

To a 2-liter flask are added 252 g of calcium polyisobutenyl sulfonate prepared as above, 850 ml hydrocarbon thinner, 75 ml 2-ethyl-1-hexanol, 55 ml methanol and 95 g calcium hydroxide. This mixture is carbonated at ambient temperature for 2½ hours with $CO_2$. The temperature of the mixture is then raised to 133° C bottoms at atmospheric pressure. It is then cooled and 700 ml hydrocarbon thinner is added. The mixture is filtered through diatomaceous earth and stripped to 165° C bottoms at 8 mm Hg to yield 368 g of calcium carbonate overbased calcium polyisobutenyl sulfonate having an alkalinity value of 349 (12.45% basic calcium) and a base ratio of 21.5:1. By Hyamine titration the product contains 0.58% neutral calcium as the sulfonate.

EXAMPLE 12

Calcium Carbonate Overbased Calcium Polyisobutenyl Sulfonate

To a 1-liter flask is added 510 g of polyisobutylene having an average number molecular weight of 950 and 96 g chlorophenyl vinyl sulfonate. The mixture is heated at 220° C for 23 hours and after cooling transferred to a 2-liter, 3-neck flask with 50 ml hydrocarbon thinner. 800 ml of methanol is added and the mixture is heated at reflux, 64° C, for ¾ of an hour. 200 ml of n-hexane is added and stirred for about 2 minutes. The mixture is allowed to stand at ambient temperature for 1¾ hours and the supernatant liquid is decanted. 800 ml methanol is added and the mixture is heated at reflux, 59° C. for ¾ hour. The mixture is allowed to settle for ½ hour at ambient temperature. 200 ml methanol is then added and the mixture allowed to settle at ambient temperature for 2 days. The supernatant liquid is decanted and solvent is stripped to 165° C bottoms at 5 mm Hg to yield 463 g of product containing 1.24% sulfur and 1.20% chlorine. To a 2-liter, 3-neck flask is added 422 g of the product prepared above and 350 ml hydrocarbon thinner. A solution of 17 g sodium hydroxide pellets in 25 ml water is added and the mixture heated at 100°-110° C for 1 hour. A solution of 55 g calcium chloride in about 500 ml water is then added and stirred at 85° C for 1 hour, transferred to a 4-liter separatory funnel, and 500 ml 2-butanol is added and mixed thoroughly. The mixture is allowed to stand overnight and the lower layer is removed. The product is transferred to a 2-liter flask and 55 g calcium chloride in 500 ml water is added. The mixture is stirred at 80° C for 1 hour, allowed to stand and the lower layer removed. The mixture is again treated with 55 g calcium chloride in 500 ml water and stirred at 80° C for 1 hour, followed by removal of the lower layer. The mixture is then treated 2 times with 500 ml water only. The product is transferred to a 2-liter flask and the alcohol-water mixture distilled to 120° C bottoms at 250 mm Hg pressure. The mixture is cooled to 50° C and 500 ml hydrocarbon thinner is added. The mixture is filtered through diatomaceous earth and then stripped to 190° C bottoms at 5 mm Hg to yield 397 g of product. To this is added 133 g diluent oil and the calcium polyisobutenyl sulfonate mixture in the oil is heated to 150° C with stirring to yield 530 g of an oil solution of the product, having an alkalinity value of 0.47, containing 0.52% calcium as sulfonate by Hyamine titration and 0.93% sulfur, 0.03% chlorine and 0.56% calcium by x-ray fluorescence analysis.

To a 1-liter flask are added 200 g of the oil solution of calcium polyisobutenyl sulfonate prepared above, 500 ml xylene, 50 ml methanol, 67 ml 2-ethyl-1-hexanol and 60 g calcium hydroxide. This mixture is carbonated with $CO_2$ at ambient temperature (25°-49° C) for 45 minutes. The temperature is then raised to 135° C to distill out methanol and water. The mixture is then cooled and filtered through diatomaceous earth and stripped to 175° C bottoms at 5 mm Hg to yield 250 g calcium carbonate overbased calcium polyisobutenyl sulfonate, which is again filtered through diatomaceous earth to yield a product having an alkalinity value of 236 and containing 8.43% basic calcium. The product has a base ratio of 18.7.

EXAMPLE 13

General Motors Sequence IIC Rust Test

Lubricating oil formulations containing conventional commercial overbased sulfonates were evaluated in comparison to the sulfonate of Example 5 in the General Motors Sequence IIC Rust Test. The test oil is an R.I. Sun Puerto Rico SAE 30 lubricating oil. Formulation I contains 4.0% of a conventional succinimide dispersant, 24 mmols/kg of a calcium phenate, 18 mmols/kg of a zinc dihydrocarbyl dithiophosphate, and 24 mmols/kg of the overbased sulfonate being tested. Formulation II contains 8.0% of a conventional succinimide dispersant, 25 mmols/kg of a conventional, non-overbased calcium sulfonate, 19 mmols/kg of a calcium phenate, 18 mmols/kg of a zinc dihydrocarbyl dithiophosphate and 18 mmols/kg of the overbased sulfonate being tested. The average engine rust (AER) is measured after 32 hours, with lower ratings indicating poorer performance. GM specifications require at least an AER rating of 8.4 to pass the test. The results are reported in Table I below.

TABLE I

| Sequence IIC Rust Test Performance | |
|---|---|
| Composition Tested | AER Rating |
| Formulation I containing conventional overbased sulfonate | 7.3 |
| Formulation I containing Example 5 overbased sulfonate | 8.4 |
| Formulation II containing conventional overbased sulfonate | 7.8 |
| Formulation II containing Example 5 overbased sulfonate | 8.4 |

EXAMPLE 14

Caterpillar Engine Test

The lubricating oil compositions of this invention were tested in a high-output diesel engine test to evaluate the ring-sticking performance of the lubricant. The test is carried out in a Caterpillar 1-G engine run until ring sticking was recorded.

The base oil used in these tests is a Mid-Continent base stock SAE 30 oil containing 3% of a conventional succinimide dispersant, 7 mmols/kg of a zinc dialkylaryl dithiophosphate and 11 mmols/kg of a zinc dialkyl dithiophosphate. To this base oil is added 41 mmols/kg of the of the overbased sulfonate to be tested. For comparison, 41 mmols/kg commercially available overbased calcium sulfonate having a base ratio of about 9 was also tested. The sulfonate designated as "Z" in Table II is the commercially available sulfonate. The results of testing the lubricating oils of this invention as well as the lubricating oils containing the commercially available sulfonate are set forth in Table II.

TABLE II

| Caterpillar Engine Test | |
|---|---|
| Composition Tested | Hours to Ring Sticking |
| 41 mmols/kg Z | 6, 10 |
| 41 mmols/kg product of A | 63[2]; 8, 6[1] |
| 36 mmols/kg Z + 5 mmols/kg neutral product of Ex. 3 | 30, 27[1] |
| 41 mmols/kg product of Ex. 5 | 72[3] |
| 41 mmols/kg product of Ex. 6 | 45 |
| 41 mmols/kg product of Ex. 4 | 67[3] |

[1]Results of repeat tests
[2]Ring probably stuck at less than 20 hours, but the engine did not shut down
[3]Ring was still free when test terminated From the data in Table II, it can be seen that the overbased calcium sulfonates of this invention are significantly better detergents than the commercially available sulfonate or the neutral sulfonate, even when combined with the commercially available sulfonate.

EXAMPLE 15

Nippon Oil Company Bomb Test

To determine the hydrolytic stability of the overbased sulfonates of this invention, the Nippon Oil Company Bomb Test is used. In this procedure the overbased sulfonate to be tested is diluted to an alkalinity value (AV) of 15 in a neutral diluent oil. 5 ml water is added to 50 g of the 15-AV test oil. The mixture is heated for 2 hours at 150° C under nitrogen in the ASTM D-2272 Bomb Oxidation Stability Test Apparatus, but without a catalyst.

An aliquot of the tested oil is diluted with an equal volume of pentane and centrifuged for ½ hour at 6000 rpm. The supernatant solution is decanted and filtered through diatomaceous earth. The solvent is evaporated from the clear solution and the alkalinity values of the fresh oil and the test oil are measured to determine the percent alkalinity value loss. The results of this test are set forth in Table III below. The sulfonate designated as "Z" in the table is a commercially available sulfonate.

TABLE III

| Nippon Oil Company Bomb Test | |
|---|---|
| Composition Tested | Alkalinity Loss, % |
| Sulfonate Z | 90–100 |
| Sulfonate A | 100 |
| Sulfonate of Example 10 | 23 |
| Sulfonate prepared by method of Ex. 4 | 3[1] |
| Sulfonate prepared by method of Ex. 8 | 8[2] |
| Sulfonate prepared by method of Ex. 9 | 3[2] |

[1]Average of 8 tests
[2]Average of 3 tests

What is claimed is:

1. A Group II metal carbonate overbased metal sulfonate of the formula R—$SO_3M$ wherein R is a substantially saturated aliphatichydrocarbyl substituent containing 50 to about 300 aliphatic carbon atoms and M is a Group I or Group II metal or lead.

2. The overbased sulfonate of claim 1 wherein M is lithium, potassium, sodium, magnesium, calcium, strontium, barium or zinc.

3. The overbased sulfonate of claim 2 wherein the hydrocarbyl substituent contains from about 50 to about 250 aliphatic carbon atoms.

4. The overbased sulfonate of claim 3 wherein the overbasing Group II metal is calcium, barium or magnesium and M is calcium, barium or magnesium.

5. The overbased sulfonate of claim 4 wherein R is polyisobutenyl.

6. The overbased sulfonate of claim 5 wherein R has a molecular weight from 800 to 1200 and the Group II metal is calcium or magnesium.

7. A concentrated lubricating oil additive composition comprising: (A) 90 to 10 weight percent of an oil of lubricating viscosity, and (B) 10 to 90 weight percent of an oil-soluble composition of claim 1.

8. A composition comprising: (A) an oil of lubricating viscosity, and (B) a dispersant amount of an oil-soluble composition of claim 1.

9. In a method for lubricating a device, the improvement comprising using a lubricant composition containing the overbased sulfonate of claim 1.

* * * * *